US007218168B1

(12) United States Patent
Rahman

(10) Patent No.: US 7,218,168 B1
(45) Date of Patent: May 15, 2007

(54) LINEAR VOLTAGE REGULATOR WITH DYNAMICALLY SELECTABLE DRIVERS

(75) Inventor: Arifur Rahman, San Jose, CA (US)

(73) Assignee: Xilinx, Inc., San Jose, CA (US)

( * ) Notice: Subject to any disclaimer, the term of this patent is extended or adjusted under 35 U.S.C. 154(b) by 122 days.

(21) Appl. No.: 11/210,497

(22) Filed: Aug. 24, 2005

(51) Int. Cl.
*G05F 1/10* (2006.01)

(52) U.S. Cl. ..... 327/540; 323/273

(58) Field of Classification Search ..... 327/540, 327/541, 543; 323/273, 281
See application file for complete search history.

(56) References Cited

U.S. PATENT DOCUMENTS 6,535,047 B2 * 3/2003 Mughal et al. ..... 327/378
6,756,810 B2 * 6/2004 Mughal et al. ..... 326/30

OTHER PUBLICATIONS

Rincon-Mora, Gabriel A.; "A Low-Voltage, Low Quiescent Current, Low Drop-Out Regulator", Jan. 1998, pp. 36-44, IEEE Journal of Solid State Circuits, vol. 33, No. 1, available from IEEE, 3 Park Avenue, 17th Floor, New York, NY 10016-5997.

* cited by examiner

*Primary Examiner*—Kenneth B. Wells
(74) *Attorney, Agent, or Firm*—W. Eric Webostad

(57) ABSTRACT

A voltage regulator and a method for voltage regulation are described. An adjustable driver is coupled to receive an input voltage, a gating voltage, and first control signaling. The adjustable driver includes driver transistors. The adjustable driver is configured to provide a drive current responsive to the gating voltage. The drive current is provided through one or more of the driver transistors at least a portion of which are selectively gated responsive to the first control signaling. A controller is coupled to receive the input voltage and the gating voltage. The controller is configured to provide the first control signaling responsive to the gating voltage. Control circuitry is configured to provide the gating voltage responsive to load current.

20 Claims, 6 Drawing Sheets

LINEAR VOLTAGE REGULATOR WITH DYNAMICALLY SELECTABLE DRIVERS

FIELD OF THE INVENTION

One or more aspects of the invention generally relate to integrated circuits and, more particularly, to a linear voltage regulator with dynamically selectable drivers.

BACKGROUND OF THE INVENTION

Programmable logic devices ("PLDs") are a well-known type of integrated circuit that can be programmed to perform specified logic functions. One type of PLD, the field programmable gate array ("FPGA"), typically includes an array of programmable tiles. These programmable tiles can include, for example, input/output blocks ("IOBs"), configurable logic blocks ("CLBs"), dedicated random access memory blocks ("BRAMs"), multipliers, digital signal processing blocks ("DSPs"), processors, clock managers, delay lock loops ("DLLs"), and so forth. Notably, as used herein, "include" and "including" mean including without limitation. One such FPGA is the Xilinx Virtex™ FPGA available from Xilinx, Inc., 2100 Logic Drive, San Jose, Calif. 95124.

Another type of PLD is the Complex Programmable Logic Device ("CPLD"). A CPLD includes two or more "function blocks" connected together and to input/output ("I/O") resources by an interconnect switch matrix. Each function block of the CPLD includes a two-level AND/OR structure similar to those used in Programmable Logic Arrays ("PLAs") and Programmable Array Logic ("PAL") devices. Other PLDs are programmed by applying a processing layer, such as a metal layer, that programmably interconnects the various elements on the device. These PLDs are known as mask programmable devices. PLDs can also be implemented in other ways, for example, using fuse or antifuse technology. The terms "PLD" and "programmable logic device" include but are not limited to these exemplary devices, as well as encompassing devices that are only partially programmable.

For purposes of clarity, FPGAs are described below though other types of integrated circuits, including other types of PLDs, may be used. FPGAs may include one or more embedded microprocessors. For example, a microprocessor may be located in an area reserved for it, generally referred to as a "processor block."

Heretofore, linear voltage regulators had a quiescent or standby current which was excessive owing to having to size a drive transistor sufficiently large to allow sufficient drive current. Accordingly, it would be desirable and useful to provide an adjustable driver where quiescent current may be reduced responsive to a reduction in load current.

SUMMARY OF THE INVENTION

One or more aspects of the invention generally relate to integrated circuits and, more particularly, to a linear voltage regulator with dynamically selectable drivers.

An aspect of the invention is a voltage regulator. An adjustable driver is coupled to receive an input voltage, a gating voltage, and control signaling. The adjustable driver includes driver transistors. The adjustable driver is configured to provide a drive current responsive to the gating voltage. The drive current is provided through one or more of the driver transistors, where the gating voltage is selectively applied to at least a portion of the one or more of the driver transistors responsive to the control signaling. A controller is coupled to receive the input voltage and the gating voltage. The controller is configured to provide the control signaling responsive to the gating voltage. Control circuitry is configured to provide the gating voltage responsive to load current.

Another aspect of the invention is a voltage regulator, comprising a first and a second adjustable driver. The first and the second adjustable driver are coupled to receive an input voltage and a gating voltage. The first adjustable driver is coupled to receive first control signaling and configured to select one or more first driver transistors responsive to the first control signaling. The second adjustable driver is coupled to receive second control signaling and configured to select one or more second driver transistors responsive to the second control signaling. The first adjustable driver and the second adjustable driver are configurable to provide at least a portion of a drive current from the input voltage through the one or more first driver transistors selected and the one or more second driver transistors selected, wherein the one or more first driver transistors selected and the one or more second driver transistors selected are selectively coupled to the gating voltage respectively responsive to the first control signaling and the second control signaling. A controller is coupled to receive the input voltage and the gating voltage. The controller is configured to provide the second control signaling responsive to the gating voltage. Control circuitry is configured to provide the gating voltage responsive to a reference voltage and a feedback voltage which is responsive to load current.

Yet another aspect of the invention is a method for voltage regulation. A gating voltage is generated responsive to a reference voltage and a feedback voltage. The gating voltage is sensed as an indicator of load current. A number of first transistor drivers used to pass at least a portion of the load current from a voltage supply are programmably adjusted responsive to the gating voltage sensed. The gating voltage is selectively coupled to the number of first transistor drivers responsive to the adjusting.

BRIEF DESCRIPTION OF THE DRAWINGS

Accompanying drawing(s) show exemplary embodiment(s) in accordance with one or more aspects of the invention; however, the accompanying drawing(s) should not be taken to limit the invention to the embodiment(s) shown, but are for explanation and understanding only.

DETAILED DESCRIPTION OF THE DRAWINGS

In the following description, numerous specific details are set forth to provide a more thorough description of the specific embodiments of the invention. It should be apparent, however, to one skilled in the art, that the invention may be practiced without all the specific details given below. In other instances, well known features have not been described in detail so as not to obscure the invention. For ease of illustration, the same number labels are used in different diagrams to refer to the same items; however, in alternative embodiments the items may be different.

Figure 1:
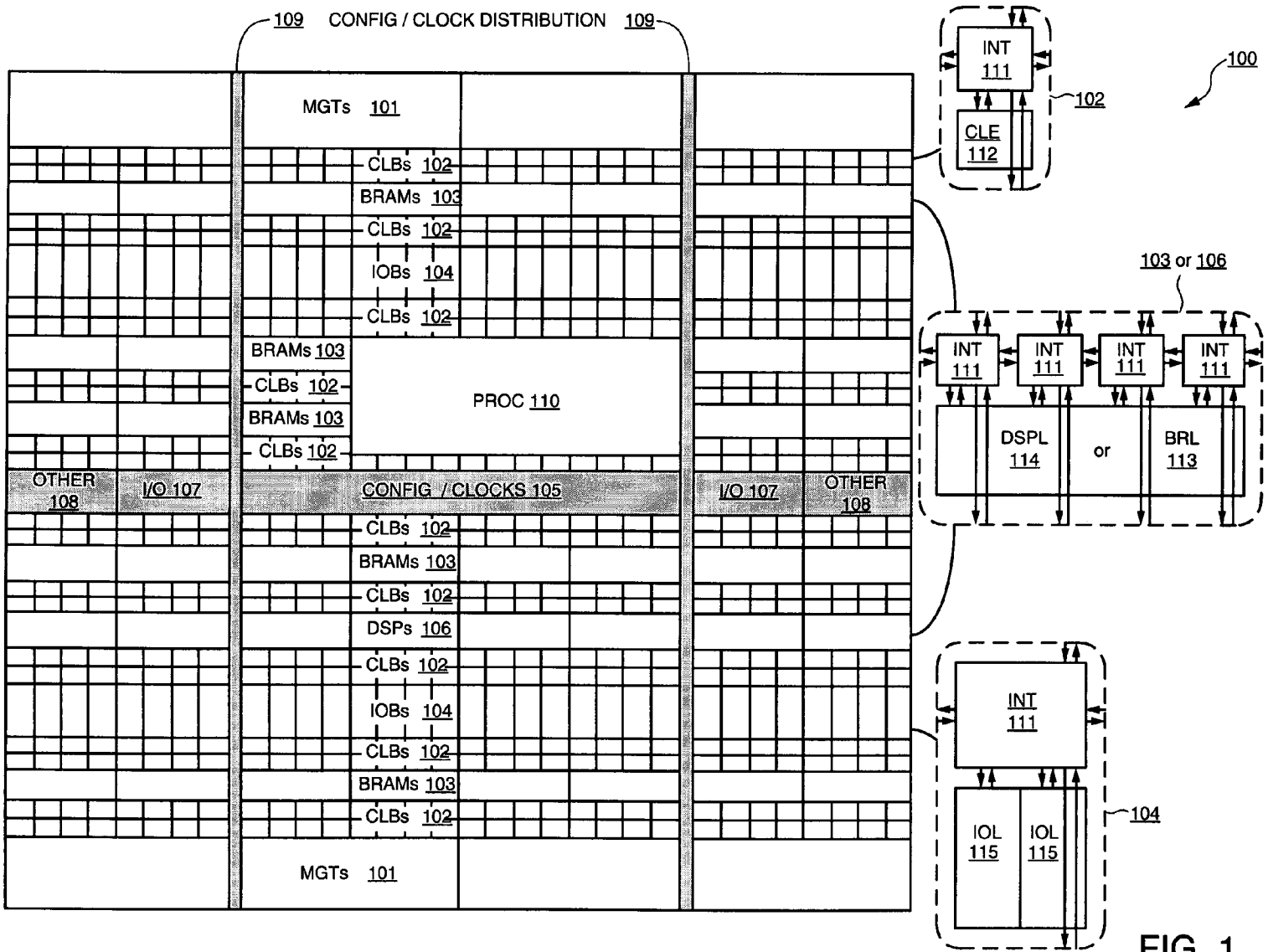
FIG. 1 is a block/schematic diagram depicting an exemplary embodiment of a columnar Field Programmable Gate Array ("FPGA") architecture in which one or more aspects of the invention may be implemented.

FIG. 1 illustrates an FPGA architecture 100 that includes a large number of different programmable tiles including multi-gigabit transceivers ("MGTs") 101, configurable logic blocks ("CLBs") 102, random access memory blocks ("BRAMs") 103, input/output blocks ("IOBs") 104, configuration and clocking logic ("CONFIG/CLOCKS") 105, digital signal processing blocks ("DSPs") 106, specialized input/output ports ("I/O") 107 (e.g., configuration ports and clock ports), and other programmable logic 108 such as digital clock managers, analog-to-digital converters, system monitoring logic, and so forth. Some FPGAs also include one or more dedicated processor blocks ("PROC") 110.

In some FPGAs, each programmable tile includes a programmable interconnect element ("INT") 111 having standardized connections to and from a corresponding interconnect element 111 in each adjacent tile. Therefore, the programmable interconnect elements 111 taken together implement the programmable interconnect structure for the illustrated FPGA. Each programmable interconnect element 111 also includes the connections to and from any other programmable logic element(s) within the same tile, as shown by the examples included at the right side of FIG. 1.

For example, a CLB 102 can include a configurable logic element ("CLE") 112 that can be programmed to implement user logic plus a single programmable interconnect element 111. A BRAM 103 can include a BRAM logic element ("BRL") 113 in addition to one or more programmable interconnect elements 111. Typically, the number of interconnect elements included in a tile depends on the height of the tile. In the pictured embodiment, a BRAM tile has the same height as four CLBs, but other numbers (e.g., five) can also be used. A DSP tile 106 can include a DSP logic element ("DSPL") 114 in addition to an appropriate number of programmable interconnect elements 111. An IOB 104 can include, for example, two instances of an input/output logic element ("IOL") 115 in addition to one instance of the programmable interconnect element 111. As will be clear to those of skill in the art, the actual I/O pads connected, for example, to the I/O logic element 115 are manufactured using metal layered above the various illustrated logic blocks, and typically are not confined to the area of the I/O logic element 115.

In the pictured embodiment, a columnar area near the center of the die (shown shaded in FIG. 1) is used for configuration, I/O, clock, and other control logic. Vertical areas 109 extending from this column are used to distribute the clocks and configuration signals across the breadth of the FPGA.

Some FPGAs utilizing the architecture illustrated in FIG. 1 include additional logic blocks that disrupt the regular columnar structure making up a large part of the FPGA. The additional logic blocks can be programmable blocks and/or dedicated logic. For example, the processor block 110 shown in FIG. 1 spans several columns of CLBs and BRAMs.

Note that FIG. 1 is intended to illustrate only an exemplary FPGA architecture. The numbers of logic blocks in a column, the relative widths of the columns, the number and order of columns, the types of logic blocks included in the columns, the relative sizes of the logic blocks, and the interconnect/logic implementations included at the right side of FIG. 1 are purely exemplary. For example, in an actual FPGA more than one adjacent column of CLBs is typically included wherever the CLBs appear, to facilitate the efficient implementation of user logic. FPGA 100 illustratively represents a columnar architecture, though FPGAs of other architectures, such as ring architectures for example, may be used. FPGA 100 may be a Virtex-4™ FPGA from Xilinx of San Jose, Calif.

Figure 2:
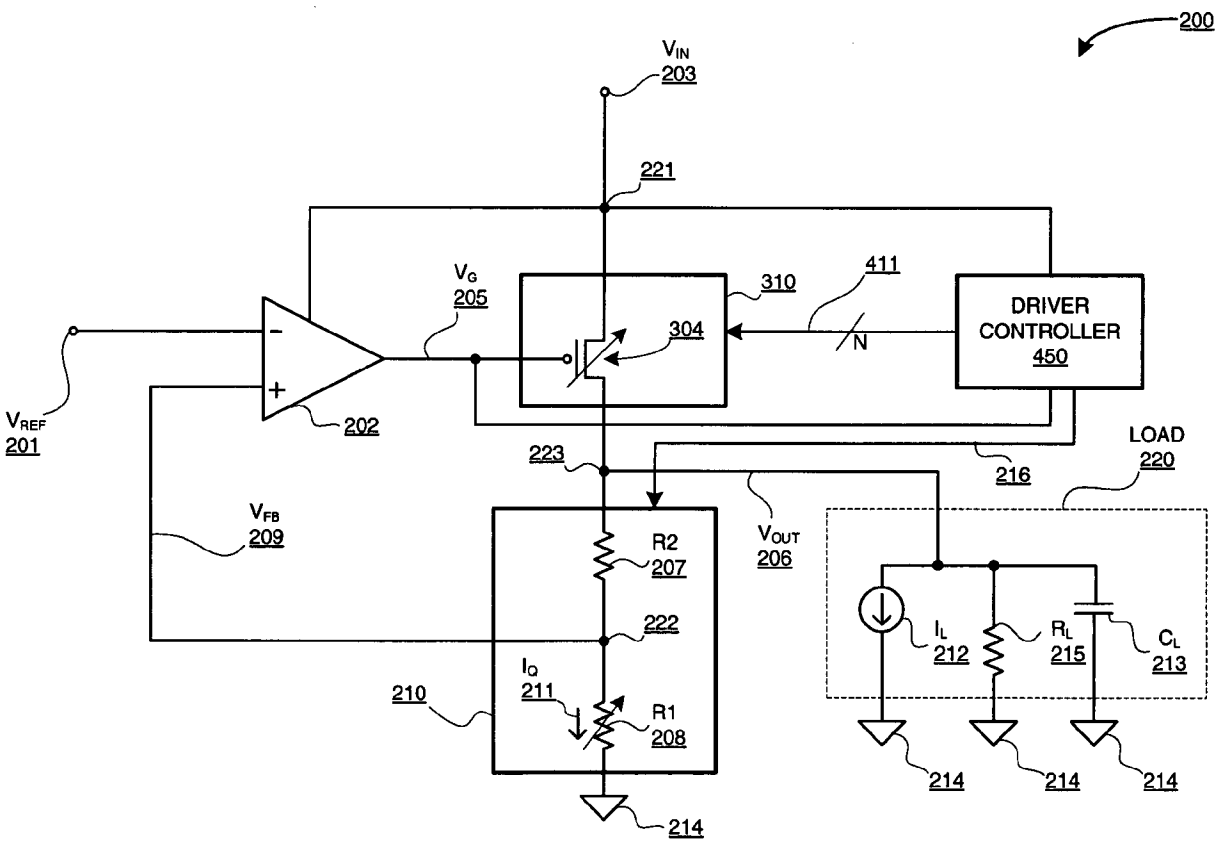
FIG. 2 is a block/schematic diagram depicting an exemplary embodiment of a linear voltage regulator with a programmable driver.

FIG. 2 is a block/schematic diagram depicting an exemplary embodiment of a linear voltage regulator 200 with adjustable driver 310. Notably, PMOS drivers are illustratively shown, and thus for purposes of clarity by way of example and not by way of limitation, adjustable driver 310 is referred to as an adjustable PMOS driver. A reference voltage ("$V_{REF}$") 201 is provided to a negative input terminal of differential amplifier 202. Provided to a positive input terminal of differential amplifier 202 is a feedback voltage ("$V_{FB}$") 209. Output of differential amplifier 202, indicated as gating voltage ("$V_G$") 205, is responsive to the difference between reference voltage 201 and feedback voltage 209. Gating voltage 205 output from differential amplifier 202 is coupled to gates of PMOS transistors 304 of adjustable PMOS driver 310. As is known, PMOS transistors are conventionally employed for pulling up voltage. However, it should be appreciated that NMOS drivers may be used in the CMOS architecture of a linear voltage regulator as described below in additional detail. A source terminal of PMOS transistors, generally indicated as a single variable PMOS transistor 304, is coupled to an input voltage ("$V_{IN}$") 203 at input voltage node 221. Input voltage 203 is also coupled at node 221 to a supply voltage terminal of differential amplifier 202.

A drain terminal of PMOS transistors 304 is coupled to an output node 223. Coupled between output node 223 and feedback node 222 is a resistor ("R2") 207. Coupled between feedback node 222 and ground 214 is another resistor ("R1") 208. Resistors 207 and 208 form a voltage divider 210 and are coupled to one another via a feedback node 222, where feedback voltage 209 may be sampled. Notably, voltage divider 210 may be simplified to indicate a current source from output node 223 to ground 214, namely to indicate standby or quiescent current ("$I_Q$") 211. Alternatively, rather than a fixed resistance, resistor 208 may be implemented as a variable resistor, which resistance is controllably varied responsive to control signal 216 from driver controller 450.

Output voltage ("$V_{OUT}$") 206 sampled at output voltage node ("output node") 223 of voltage regulator 200 may be coupled to other circuits of an integrated circuit, generally indicated as load 220. Load 220 may include a resistive load ("$R_L$") 215, a capacitive load ("$C_L$") 213, and a load current ("$I_L$") 212, which are each generally indicated in FIG. 2 as coupled to ground 214 at one end and to output node 223 at another end. Note that load 220 is merely an abstracted representation of actual circuits that may be coupled to voltage regulator 200.

Notably, when load 220 is in a substantially inactive state, load current 212 correspondingly will be substantially low, and resistive load 215 will be substantially high. In this state, it would be desirable to have only one or only a limited number of PMOS transistors 304 active and adjust the resistance of a biasing resistor, such as an variable resistor 208, such that quiescent current 211 passing through such biasing resistor is reduced. In other words, by having only one or only a limited number of PMOS transistors active and increasing the resistance of resistor 208, there is less current passing through resistor 208, and thus quiescent current 211 may correspondingly be reduced.

Notably, quiescent current 211 (in the steady state) is reference voltage 201 divided by resistance of resistor 208. Control signal 216 used to vary resistance of resistor 208 may be an analog or a digital signal, whereas control signal 411 is a digital signal. When load 220 is high, conversely resistance of resistor 208 may be decreased responsive to control signal 216. Thus, resistance of resistor 208 may be controllably adjusted to generally maintain a biasing voltage, such as gating voltage 205, at a same level within a target range.

When load 220 is in a substantially active state, load current 212 is substantially high and load resistance 215 is substantially low. Additionally, capacitive load 213 when load 220 is in a substantially active state is likewise substantially high. Accordingly, it would be desirable to have a significant number of PMOS transistors active in order to provide sufficient drive current for load current 212.

Notably, an example of a linear voltage regulator is provided for purposes of clarity by way of example and not limitation. It should be understood that variations may be made with respect to sensing feedback voltage for providing a gating voltage.

Furthermore, it should be appreciated that voltage regulator 200 is a "low drop-out" ("LDO") voltage regulator. Such a voltage regulator may be used to generate an internal supply voltage in an integrated circuit, such as FPGA 100 as illustratively shown in FIG. 1. Furthermore, such an internal power supply voltage may be generated for configuration memory of FPGA 100 using LDO voltage regulator 200. The description that follows describes dynamic adjustment of the number of PMOS transistors 304 and thus the overall effective size of such PMOS drive in LDO voltage regulator 200. This dynamic adjustment facilitates a reduction in leakage or quiescent current 211 and hence a reduction of quiescent or standby power consumption of LDO voltage regulator 200. Additionally, a biasing current, such as quiescent current 211, may be controlled responsive to condition of load 220, as previously described, to reduce standby power consumption of LDO voltage regulator 200.

Notably, to reduce variation in output current of LDO voltage regulator 200 due to differences in process variation, voltage, and temperature, generally known as "PVT" conditions, a value of quiescent current 211 is selected to minimize variation in output current, namely the sum of load current 212 and quiescent current 211. Thus, by varying quiescent current 211 responsive to changes in load current 212, a more PVT condition-stable LDO voltage regulator 200 is provided, as load current will vary according to differences in PVT conditions. Furthermore, it should be appreciated from the disclosure that follows that operating range of differential amplifier output gating voltage 205 may scale with the number of active PMOS drivers, namely PMOS transistors 304, responsive to changes in load current 212. A driver controller 450 may be coupled to provide control signal 411 to PMOS driver 310 responsive to gating voltage 205. Control signal 411 may be N bits wide for N a positive integer greater than zero, and thus may be generally referred to as control signal 411 although multiple signals in parallel may be provided. Furthermore, it should be appreciated that the substrate bias need not be modified to provide different PMOS driver strength. In other words, operating range of LDO voltage regulator 200 is not limited by limitations of substrate voltage bias. Accordingly, LDO voltage regulator 200 may be configured to provide a wide range of load current. Additionally, LDO voltage regulator 200 may be configured to be stable over such a wide range of load current with a limited output slew rate.

Figure 3:
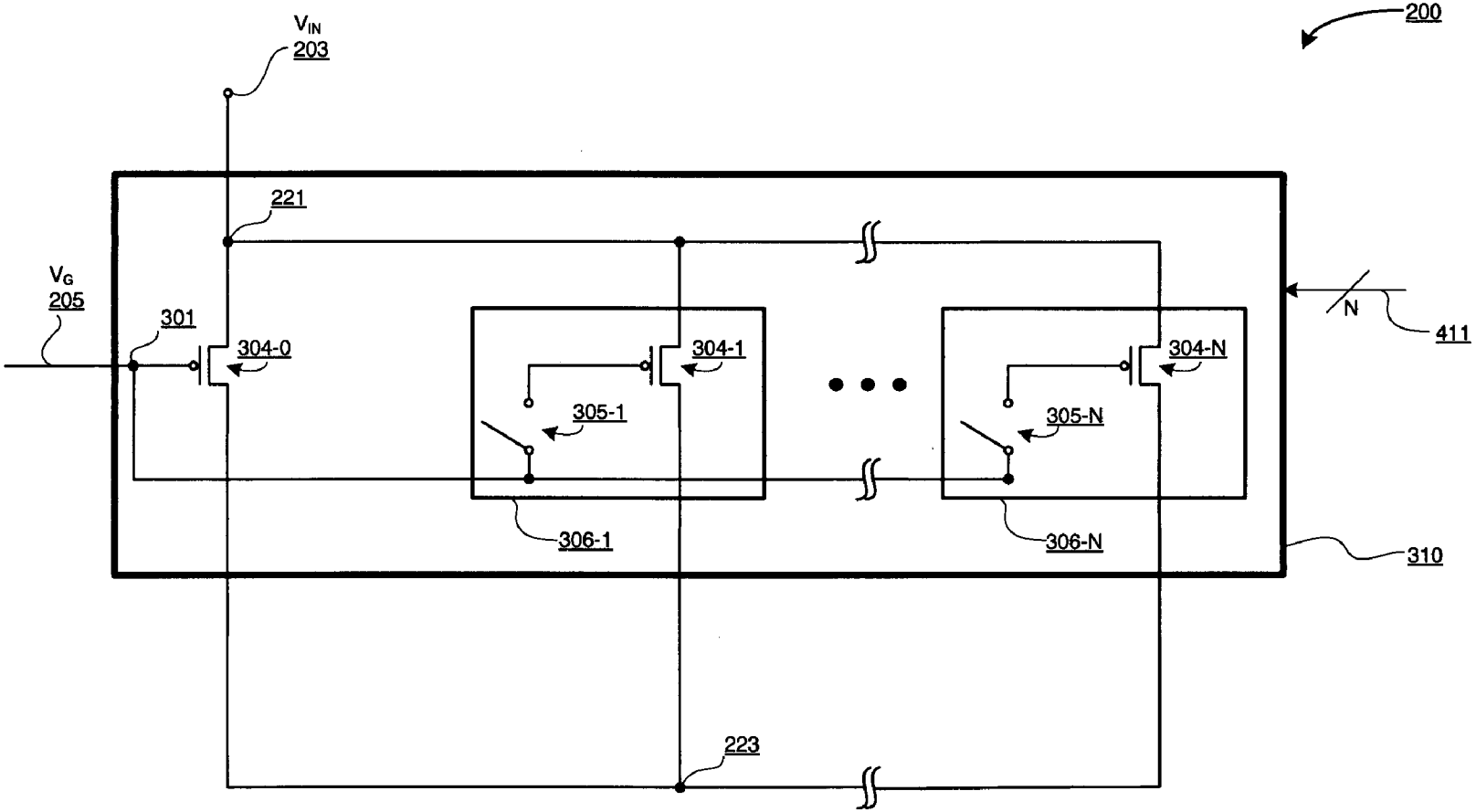
FIG. 3 is a block/schematic diagram depicting an exemplary embodiment of the programmable driver of the linear voltage regulator of FIG. 2.

FIG. 3 is a block/schematic diagram depicting an exemplary embodiment of adjustable PMOS driver 310 of LDO voltage regulator 200. PMOS transistors 304-0 through 304-N, for N an integer greater than one, have their source terminals commonly coupled to input voltage node 221 and have their drain terminals commonly coupled to output node 223. Notably, PMOS transistors 304-0 through 304-N need not all be the same size, although they may be. However, it may be desirable to have PMOS driver 304-0 be smaller than the other PMOS transistors 304-1 through 304-N. This is because in a substantially inactive state, load current 212 is substantially low, and thus it may be desirable at times to have a small PMOS transistor 304-0 be the only active transistor of adjustable driver 310 in order to minimize quiescent current 211, as well as to reduce gating voltage 205. Furthermore, it may be desirable to have PMOS transistors 304-0 through 304-N become progressively larger. When load 220 of FIG. 2 is substantially active, and thus load current 212 is substantially high, it may be desirable to have progressively larger PMOS transistors in order to progressively increase drive current corresponding to a sliding scale of operating range of load current 212 of load 220.

PMOS transistors 304-0 through 304-N are commonly gated at gating voltage node ("gating node") 301. Gating node 301 is coupled to the output of differential amplifier 202 to receive gating voltage 205. As illustratively shown, each of PMOS transistors 304-1 through 304-N may be considered separate adjustable driver blocks 306-1 through 306-N, where a respective switch 305-1 through 305-N is used to selectively couple gates of transistors 304-1 through 304-N to gating node 301. Although switches 305-1 through 305-N (collectively "switches 305") are illustratively shown, as it will be appreciated that there are many types of implementations of switches for selectively gating transistors. For example, such switches may be configured using an activation or reference signal, memory cells, registers, combinatorial logic, and other known switching mechanisms. Notably, as at least one transistor will be present even when load 220 is inactive, PMOS transistor 304-0 need not be dynamically selectable, and thus may be a static driver. Notably, the N-bit control signal 411 may have N separate signals respectively associated with then N number of switches 305.

Figure 4:
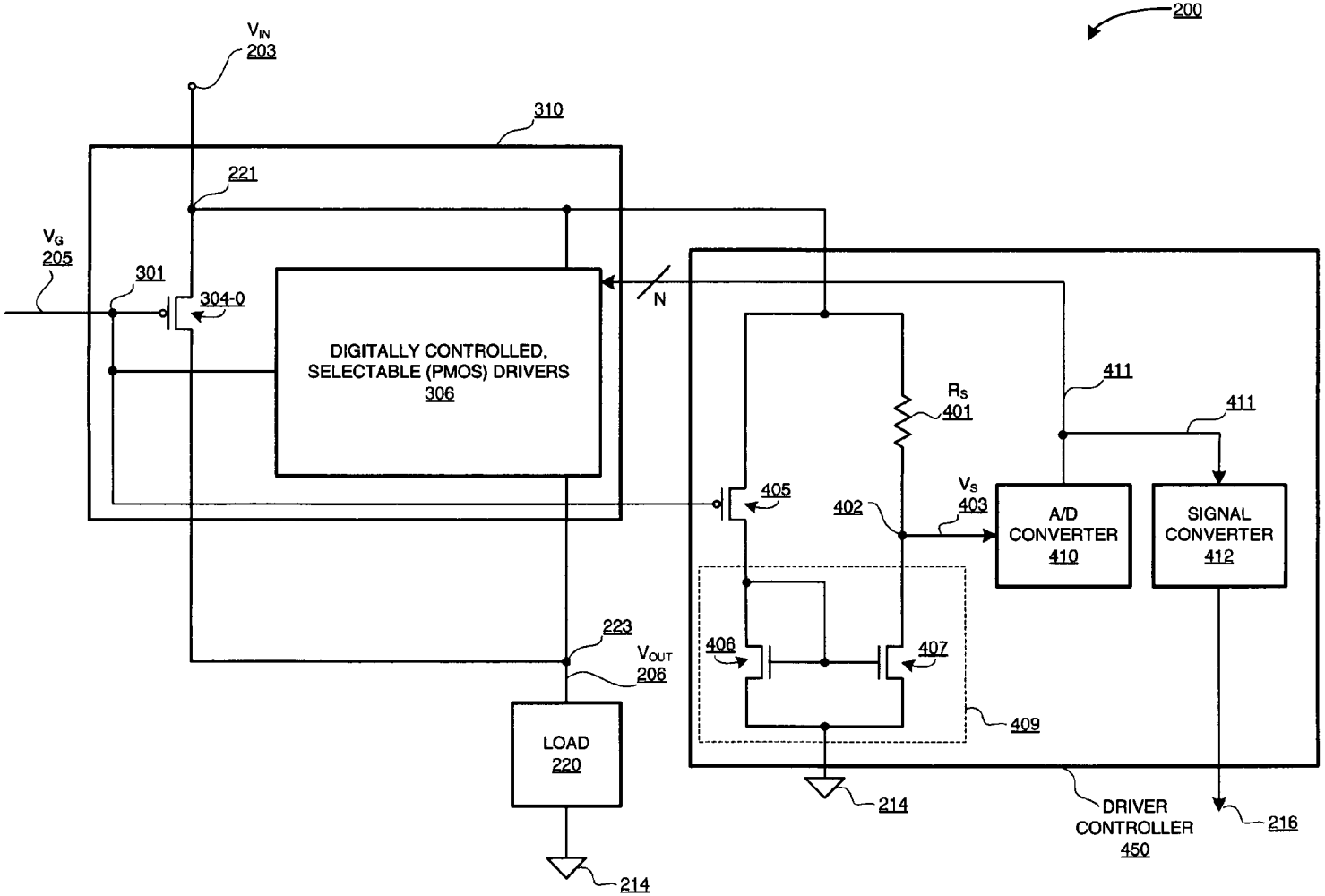
FIG. 4 is a block/schematic diagram depicting an exemplary embodiment of a portion of the linear voltage regulator of FIG. 2 with a driver controller.

FIG. 4 is a block/schematic diagram depicting an exemplary embodiment of a portion of LDO voltage regulator 200 with a driver controller 450. With simultaneous reference to FIGS. 2 through 4, LDO voltage regulator 200 is further described.

As previously indicated, one or more of PMOS transistors 304-1 through 304-N may be selected responsive to status of load current 212. Driver controller 450 is configured to sense gating voltage 205 as an indication of a change in load current 212. Accordingly, gating node 301 is coupled to a gate of PMOS transistor 405 of driver controller 450, and input node 221 is coupled to driver controller 450 at a source terminal of PMOS transistor 405.

Responsive to gating voltage 205 being low, PMOS transistors 304-0 through 304-N are substantially electrically conductive to account for a high drive current. Accordingly, PMOS transistor 405 may be sized substantially smaller than PMOS transistor 304-0 to provide a sufficient amount of sensitivity to sense changes in load current 212 without adding an undue amount of load to gating node 301. For gating voltage 205 being substantially low, transistor 405 is in a substantially conductive state. Input voltage 203 is coupled to a gate of NMOS transistor 406 and a gate of NMOS transistor 407. Notably, NMOS transistors 406 and 407 are configured in a current mirror configuration 409. NMOS transistors 406 and 407 may be comparably sized to PMOS transistor 304-0, or may be one threshold voltage level below PMOS transistor 304-0 to ensure responsiveness to changes in current load.

For a low gating voltage 205, transistors 406 and 407 are put in a substantially conductive state, thus pulling sense node 402 toward ground 214. Accordingly, sense voltage ("$V_S$") 403 will be substantially low responsive to gating voltage 205 being substantially low. Analog-to-digital ("A/D") converter 410 is coupled to sense node 402 to convert sense voltage 403 into a control signal 411. Control signal 411 may be an address that is multiple bits wide to select a number of switches 305-1 through 305-N to be activated responsive to gating voltage 205.

For gating voltage 205 being substantially high, it should be appreciated that load current 212 will be substantially low. Accordingly, transistor 405 will be substantially non-conductive. In a non-conductive state, sense voltage 403 as sampled at sense node 402 may be input voltage 203 less a voltage drop across sense resistance ("$R_S$") 401. In other words, a current conducted through transistor 405 may be approximately equal to a current passing through sense resistance 401 divided by a constant, which may vary from application to application. This current across sense resistance 401 is converted into a voltage drop which may be sensed as sense voltage 403. For sense voltage 403 being substantially high, indicating a substantially low load current, control signal 411 of analog-to-digital converter 410 provided to digitally controlled, selectable PMOS driver blocks 306 may select few if any of such driver blocks to be active. Accordingly, it should be appreciated that LDO voltage regulator 200 is configured to dynamically sense load current and provide a drive current responsive to such sensed load current.

The number and size of PMOS driver blocks 306 may vary from application to application, as well as whether any static drivers are used. It should be appreciated that the sensing voltage provided to analog-to-digital converter 410 is input voltage 203 minus voltage at node 402. Sense resistance 401 may be a fixed resistor to provide a fixed reference for such sensing; however, other forms of resistance providing circuits having sufficient stability may be used as is known. Notably, the size of current mirror transistors 406 and 407 may be selected such that they account for a small fraction of the total load current. Bias current overhead associated with driver controller 450 may be approximately in a range of 200 to 300 micro amps. Thus, it should be appreciated that by dynamically adjusting the size of PMOS drive a very small driver size responsive to a very low load current may be selected, and thus the amount of quiescent current is proportionately reduced. By having an LDO voltage regulator with a low quiescent current, a higher current efficiency may result as less power may be consumed during low load periods. As driver controller 450 may be configured to constantly sense load current, the number of PMOS drivers selected may be increased dynamically responsive to load current. Thus, the amount of drive may be a stepped sliding scale responsive to each of the PMOS transistors 304-0 through 304-N activated.

Driver controller 450 may include a signal converter 412 coupled to receive control signal 411 and configured to convert control signal 411 into control signal 216. For an analog signal 216, signal converter 412 may be a digital-to-analog converter. For a digital signal 216, signal converter 412 may be a parallel to serial converter. Alternatively, variable resistor 208 of FIG. 2 may be set directly with control signal 411, in which embodiment signal converter 412 may be omitted.

Figure 5:
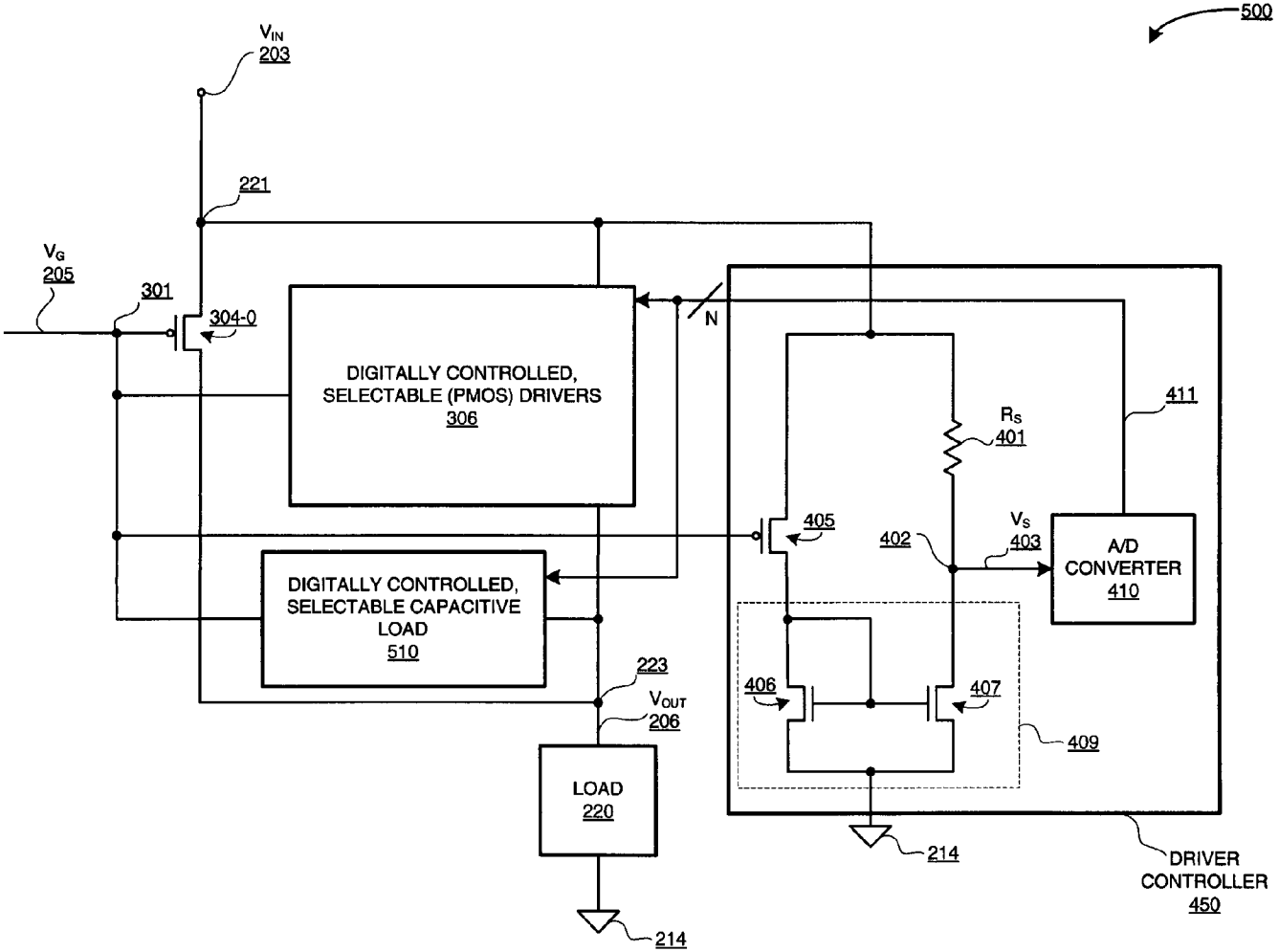
FIG. 5 is a block/schematic diagram depicting an exemplary embodiment of a linear voltage regulator similar to the linear voltage regulator of FIG. 4, except that a digitally controlled, selectable capacitive load is added.

FIG. 5 is a block/schematic diagram depicting an exemplary embodiment of an LDO voltage regulator 500. LDO voltage regulator 500 is similar to LDO voltage regulator 200 of FIG. 4, except that digitally controlled, selectable capacitive load 510 is added. Digitally controlled, selectable capacitive load 510 is coupled on an input side to receive gating voltage 205. Digitally controlled, selectable capacitive load 510 is coupled on an output side to output node 223. Thus, digitally controlled, selectable capacitive load 510 provides a capacitive shunt from gating voltage node 301 to output node 223. The effective capacitance provided by digitally controlled, selectable capacitive load 510 is adjustable responsive to control signal 411 from driver controller 450 provided to digitally controlled, selectable capacitive load 510.

Accordingly, shunt capacitance between nodes 301 and 223 provided by digitally controlled selectable capacitive load 510 is adjustable responsive to the number of drivers selected of digitally controlled, selectable PMOS drivers 306. The number of drivers selected will affect location of poles of the transfer function for LDO voltage regulator 200 of FIG. 4. In order to make such LDO voltage regulator 200 of FIG. 4 more stable, shunt capacitance provided by digitally controlled, selectable capacitive load 510 may be used to ensure that poles of the transfer function are maintained at a safe distance apart from one another.

Digitally controlled, selectable capacitive load 510 may be a bank of capacitors which are switch-selectable for coupling to provide a shunt capacitance. These switch-selectable capacitors may be controlled as previously described with respect to selecting PMOS transistors 304-1 through 304-N using switches 305-1 through 305-N as illustratively shown in FIG. 3. Selectable capacitive load 510 may also be controlled or configured with programmable resources, such as one or more CLBs or SRAM programmable memory cells (e.g., configuration memory cells of a PLD), to provide target values of compensation capacitance. Thus, drive strength, and thus associated phase margin, of LDO voltage regulator 500 may be increased to ensure stability. Notably, PMOS drive strength for the values of compensation capacitors may be selected, for example, by programming configuration memory cells of FPGA 100.

Figure 6:
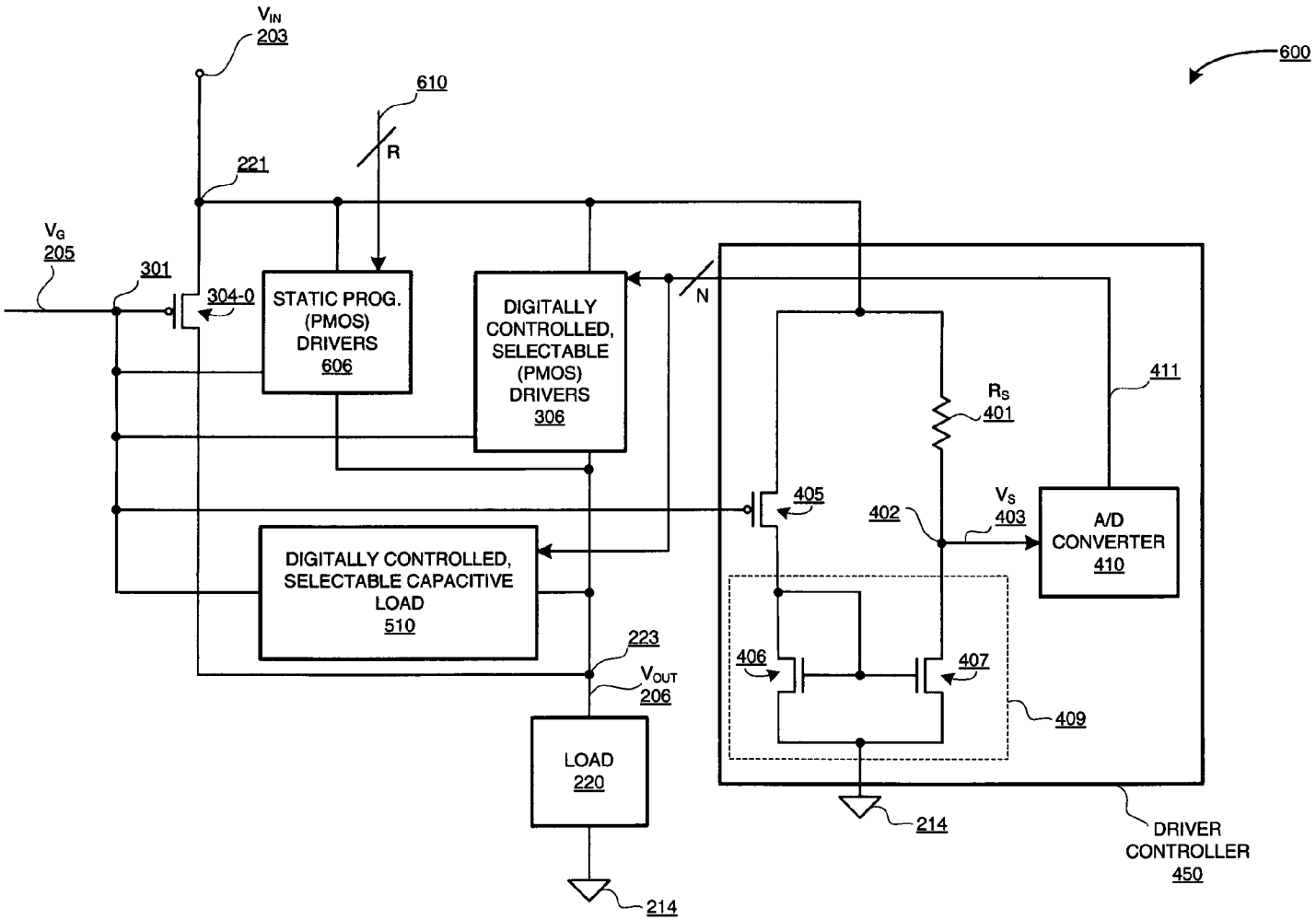
FIG. 6 is a block/schematic diagram depicting an exemplary embodiment of a portion of a linear voltage regulator similar to the linear voltage regulator of FIG. 5, except that it includes programmable PMOS drivers.

FIG. 6 is a block/schematic diagram depicting an exemplary embodiment of a portion of an LDO voltage regulator 600. LDO voltage regulator 600 of FIG. 6 is similar to LDO voltage regulator 500 of FIG. 5, except that a portion of the digitally controlled, selectable PMOS drivers 306 are programmable PMOS drivers 606. These programmable PMOS drivers 606, after programming may be used to provide a lower limit fixed drive level, and thus are referred to as static programmable PMOS drivers 606 to distinguish them from dynamically adjusted PMOS drivers 306. However, it should be understood that such static programmable PMOS drivers 606 may be reprogrammed to adjust the lower limit fixed drive level. Static programmable PMOS drivers 606 are coupled between input node 221 and output node 223, and are coupled to gating node 301 to receive gating voltage 205. Static programmable PMOS drivers 606 are coupled to receive a control signal 610, which may be R bits wide, for R an integer greater than or equal to one. Control signal 610 represents user provided programming to adjust the lower limit fixed drive level, which may vary from application to application. For example, control signal 610 may be provided by programmable resources, such as one or more CLBs or programmable memory cells (e.g., configuration memory cells of a PLD). Thus, the minimum drive of LDO voltage regulator 600 may be programmably set by adding one or more static programmable PMOS drivers 606 responsive to control signal 610. These static programmable PMOS drivers may or may not include transistor 304-0. Accordingly, static programmable PMOS drivers 606 may be programmed as previously described, though once programmed, they are not dynamically adjusted, in contrast to digitally controlled, selectable PMOS drivers 306.

Accordingly, it should be appreciated that quiescent current may be reduced responsive to load current being relatively low. More generally, it should be understood that quiescent current, namely bias current, may be dynamically adjusted responsive to loading condition. If a load is in a standby mode and thus not drawing much current, the bias current and the effective size of PMOS drivers may be accordingly reduced. For an FPGA, bias current varies across PVT conditions, where a substantial portion of such load may be based on configuration memory cells. Notably, even though SRAM configuration memory cells may not be switching, an FPGA may have PMOS drivers sized for target worst case PVT conditions. Thus, by having a bias current that is dynamically adjustable, a relatively high bias current for such worst case PVT conditions may be reduced, such as for a standby mode, when such FPGA is operating at better conditions than such worst case PVT conditions.

While the foregoing describes exemplary embodiment(s) in accordance with one or more aspects of the invention, other and further embodiment(s) in accordance with the one or more aspects of the invention may be devised without departing from the scope thereof, which is determined by the claim(s) that follow and equivalents thereof. Claim(s) listing steps do not imply any order of the steps. Trademarks are the property of their respective owners.

What is claimed is:

1. A voltage regulator, comprising:

an adjustable driver coupled to receive an input voltage, a gating voltage, and first control signaling, the adjustable driver including driver transistors, the adjustable driver configured to provide a drive current responsive to the gating voltage, the drive current provided through one or more of the driver transistors, wherein the gating voltage is selectively applied to at least a portion of the driver transistors responsive to the first control signaling;

a controller coupled to receive the input voltage and the gating voltage, the controller configured to provide the first control signaling responsive to the gating voltage; and control circuitry configured to provide the gating voltage responsive to load current.

2. The voltage regulator according to claim 1, wherein the control circuitry is configured to provide the gating voltage responsive to a reference voltage and a feedback voltage, the feedback voltage responsive to the load current, wherein the control circuitry comprises a variable resistor, the variable resistor providing a biasing resistance for providing the feedback voltage, wherein the controller is configured to provide second control signaling responsive to the gating voltage, and wherein the control circuitry is coupled to receive the second control signaling to adjust resistance of the variable resistor.

3. The voltage regulator according to claim 2, wherein the driver transistors of the adjustable driver include at least one driver transistor that is not selectable as part of the driver transistors for providing a minimum drive level.

4. The voltage regulator according to claim 2, wherein the control circuitry comprises a differential amplifier, wherein the feedback voltage and the reference voltage are coupled as inputs to the differential amplifier, and wherein the gating voltage is provided from an output of the differential amplifier.

5. The voltage regulator according to claim 1, wherein the controller includes:

a reference transistor being of a same type as the driver transistors, the reference transistor gated responsive to the gating voltage, the reference transistor sourced from the input voltage;

a current mirror circuit having a first side coupled between a drain terminal of the reference transistor and a ground reference and a second side coupled between a sense node and the ground reference;

a sense resistance coupled between the input voltage and the sense node; and an analog-to-digital converter coupled to the sense node to obtain a sense voltage therefrom and to provide the first control signaling responsive to the sense voltage.

6. The voltage regulator according to claim 5, wherein the first control signaling comprises multiple bits for selecting respective switching circuits for selectively coupling the at least a portion of the driver transistors to receive the gating voltage.

7. The voltage regulator according to claim 1, further comprising an adjustable capacitive load coupled to receive the gating voltage and commonly coupled with the driver transistors to an output voltage node, the adjustable capacitive load coupled to receive the control signaling and configured to adjust compensation capacitance responsive to the first control signaling to enhance phase margin.

8. The voltage regulator according to claim 7, wherein the adjustable capacitive load and the adjustable driver are configured from programmable resources.

9. The voltage regulator according to claim 8, wherein the programmable resources are programmable resources of a programmable logic device.

10. A voltage regulator, comprising:

a first adjustable driver and a second adjustable driver;

the first and the second adjustable driver coupled to receive an input voltage and a gating voltage;

the first adjustable driver coupled to receive first control signaling and configured to select one or more first driver transistors responsive to the first control signaling;

the second adjustable driver coupled to receive second control signaling and configured to select one or more second driver transistors responsive to the second control signaling;

the first adjustable driver and the second adjustable driver configurable to provide at least a portion of a drive current from the input voltage through the one or more first driver transistors selected and the one or more second driver transistors selected, wherein the one or more first driver transistors selected are selectively coupled to the gating voltage responsive to the first control signaling, and wherein the one or more second driver transistors selected are selectively coupled to the gating voltage responsive to the second control signaling;

a controller coupled to receive the input voltage and the gating voltage, the controller configured to provide the second control signaling responsive to the gating voltage; and control circuitry configured to provide the gating voltage responsive to a reference voltage and a feedback voltage, the feedback voltage responsive to load current.

11. The voltage regulator according to claim 10, wherein the first adjustable driver includes at least one driver transistor that is not selectable as part of the one or more first driver transistors for providing a minimum drive level.

12. The voltage regulator according to claim 10, wherein the controller is configured to provide third control signaling responsive to the gating voltage, the control circuitry coupled to receive the third control signaling to adjust resistance of a variable resistor thereof, the variable resistor providing a biasing resistance for providing the feedback voltage.

13. The voltage regulator according to claim 10, wherein the controller includes:

a reference transistor being of a same type as the one or more second driver transistors, the reference transistor gated responsive to the gating voltage, the reference transistor sourced from the input voltage;

a current mirror circuit having a first side coupled between a drain terminal of the reference transistor and a ground reference and having a second side coupled between a sense node and the ground reference;

a sense resistance coupled between the input voltage and the sense node; and an analog-to-digital converter coupled to the sense node to obtain a sense voltage therefrom and to provide the second control signaling responsive to the sense voltage.

14. The voltage regulator according to claim 13, wherein the control circuitry comprises differential amplifier, wherein the feedback voltage and the reference voltage are coupled as inputs to the differential amplifier, and wherein the gating voltage is provided from an output of the differential amplifier.

15. The voltage regulator according to claim 10, wherein the first adjustable driver is a programmable adjustable driver, and wherein the second adjustable driver is a dynamically adjustable driver.

16. The voltage regulator according to claim 15, further comprising an adjustable capacitive load coupled to receive the gating voltage and commonly coupled with the one or more first driver transistors and the one or more second driver transistors to an output voltage node, the adjustable capacitive load coupled to receive the second control signaling and configured to adjust compensation capacitance responsive to the second control signaling.

17. The voltage regulator according to claim 16, wherein the adjustable capacitive load, the programmable adjustable driver and the dynamically adjustable driver are configured from programmable resources.

18. The voltage regulator according to claim 17, wherein the programmable resources are programmable resources of a programmable logic device.

19. A method for voltage regulation, comprising:

generating a gating voltage responsive to a reference voltage and a feedback voltage;

sensing the gating voltage as an indicator of load current;

programmably adjusting first transistor drivers used to pass at least a portion of the load current from a voltage supply responsive to the gating voltage sensed; and selectively coupling the gating voltage to the first transistor drivers responsive to the adjusting.

20. The method according to claim 19, further comprising setting second transistor drivers used to pass at least another portion of the load current from the voltage supply responsive to user programming input.

* * * * *